US010813472B1

(12) United States Patent
Minemier

(10) Patent No.: US 10,813,472 B1
(45) Date of Patent: Oct. 27, 2020

(54) MOBILITY WALKER

(71) Applicant: Michael Minemier, Lexington, SC (US)

(72) Inventor: Michael Minemier, Lexington, SC (US)

( * ) Notice: Subject to any disclaimer, the term of this patent is extended or adjusted under 35 U.S.C. 154(b) by 0 days.

(21) Appl. No.: 16/751,991

(22) Filed: Jan. 24, 2020

(51) Int. Cl.
*A47D 13/04* (2006.01)
*A47D 15/00* (2006.01)

(52) U.S. Cl.
CPC ..... *A47D 13/043* (2013.01); *A47D 15/00* (2013.01)

(58) Field of Classification Search
CPC ..... A47D 13/043; A47D 1/002; A47D 1/004; A47D 1/0023
See application file for complete search history.

(56) References Cited

U.S. PATENT DOCUMENTS 1,404,572 A * 1/1922 Bowman ..... A47D 13/043 280/87.051
1,475,442 A * 11/1923 Manger ..... A47D 13/043 472/15
5,732,961 A * 3/1998 Theodoropoulos .. A47D 13/043 280/87.051
2009/0242006 A1* 10/2009 Warren ..... A61H 3/00 135/66
2012/0326409 A1 12/2012 Corso et al.
2015/0297439 A1* 10/2015 Karlovich ..... A63B 22/02 280/650
2015/0335940 A1* 11/2015 Johnson ..... A61H 3/04 248/118
2018/0186396 A1 7/2018 Rousseau

* cited by examiner

*Primary Examiner* — John D Walters
*Assistant Examiner* — James J Triggs
(74) *Attorney, Agent, or Firm* — Dale J. Ream

(57) ABSTRACT

A mobility walker includes a framework having a top portion that includes a support rail positioned parallel to the ground surface. The framework has a bottom portion that includes four support rods distributed in a square configuration and includes a plurality of vertical support members extending between the bottom and top portions such that the top portion is supported above the bottom portion. The walker includes a child support portion having a first end coupled to the support rail of the top portion and having a flexible configuration suspended from the top rail, the child support portion defining a pair of leg holes. A plurality of wheel assemblies is releasably coupled to lower ends of vertical support members. Each vertical support member defines a vertical axis oriented at an angle between 70 degrees and 90 degrees and, preferably, between 80 and 90 degrees relative to the ground surface.

8 Claims, 3 Drawing Sheets

MOBILITY WALKER

BACKGROUND OF THE INVENTION

This invention relates generally to walkers for young children and, more particularly, to a mobility walker having vertical or almost vertical support members to facilitate unobstructed vision of the infant.

A baby walker is a popular device used by parents and caregivers that enables infants or toddlers to move—or, more accurately, to roll from one place to another. In a basic form, a toddler has a base made of lightweight plastic or metal materials supported on a plurality of wheels and a suspended fabric seat having a pair leg holes for receiving an supporting the young child. The walker enables the infant to move the walker around a space using his own feet as the means of propulsion. Accordingly, an infant may have a degree of mobility even before being able to walk in a normal manner.

Various designs for baby walkers are known or disclosed in the prior art. Although presumably effective for their intended purposes, there is still a need for a mobility walker that overcomes the disadvantageous of traditional walker technologies. For example, traditional walkers have support legs (i.e. support frames) that have an overly wide footprint in the name of safety that prevent the infant from seeing the floor or the item he or she may have dropped onto the floor. Further, most walkers do not have interchangeable wheels such that the walker may be used both indoors and outdoors.

Therefore, it would be desirable to have a mobility walker having vertical support members that enable an infant to have an unobstructed view of areas adjacent the walker. Further, it would desirable to have a mobility walker having interchangeable wheels so that outdoor wheels may be installed for outdoor mobility,

SUMMARY OF THE INVENTION

A mobility walker according to the present invention includes a framework having a top portion that includes a support rail having a generally ring-shaped configuration parallel to the ground surface. The framework has a bottom portion that includes four support rods distributed in a square configuration and includes a plurality of vertical support members extending between the bottom portion and the top portion such that the top portion is supported above and displaced from the bottom portion. The walker includes a child support portion having a first end coupled to the support rail of the top portion and having a flexible configuration suspended from the top rail, the child support portion defining a pair of leg holes. A plurality of wheel assemblies is removably coupled to lower ends of the plurality of vertical support members. Each vertical support member defines a vertical axis oriented at an angle between 70 degrees and 90 degrees and, preferably, between 80 and 90 degrees relative to the ground surface.

Therefore, a general object of this invention is to provide a mobility walker that enables an infant or toddler to move along support surface whether indoors or outdoors.

Another object of this invention is to provide a mobility walker, as aforesaid, having vertical support members positioned at a near-vertical angle so that the infant has an unobstructed view over the front or side of the walker framework.

Still another object of this invention is to provide a mobility walker, as aforesaid, in which the wheel assemblies are interchangeable.

Yet another object of this invention is to provide a mobility walker, as aforesaid, that is economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
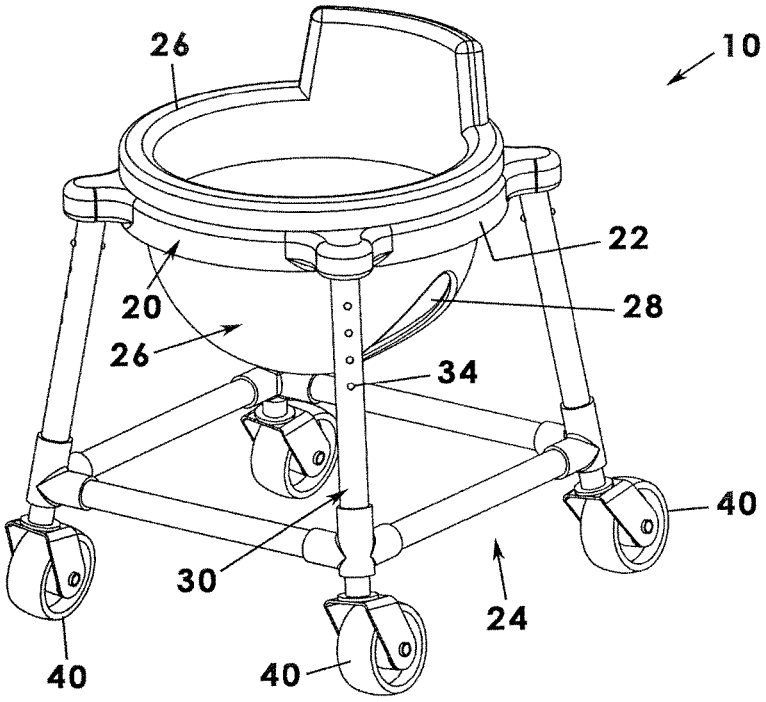
FIG. 1*a* is a perspective view of a mobility walker according to a preferred embodiment of the present invention, illustrated in a retracted configuration.
Figure 1B:
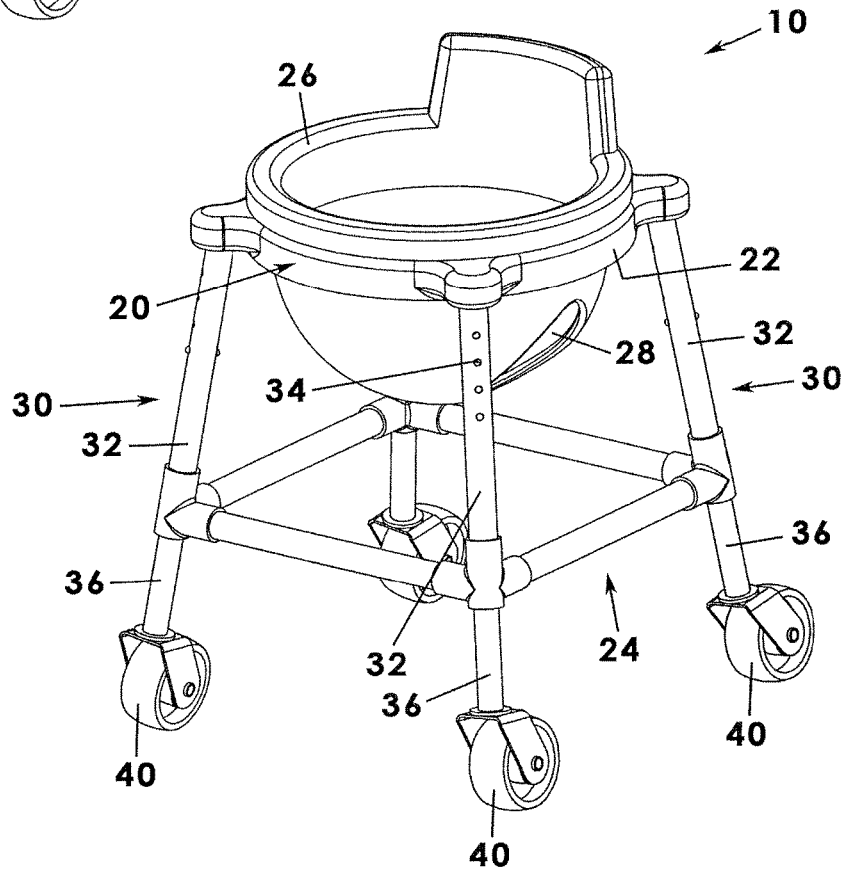
FIG. 1*b* is another perspective view of the mobility walker as in FIG. 1*a*, illustrated in a deployed or extended configuration.
Figure 2A:
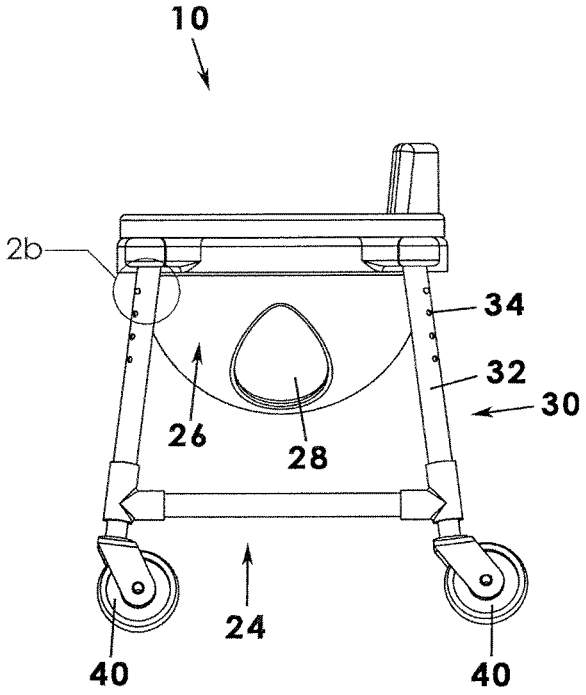
FIG. 2*a* is a side view of the mobility walker as in FIG. 1*a;*
Figure 2C:
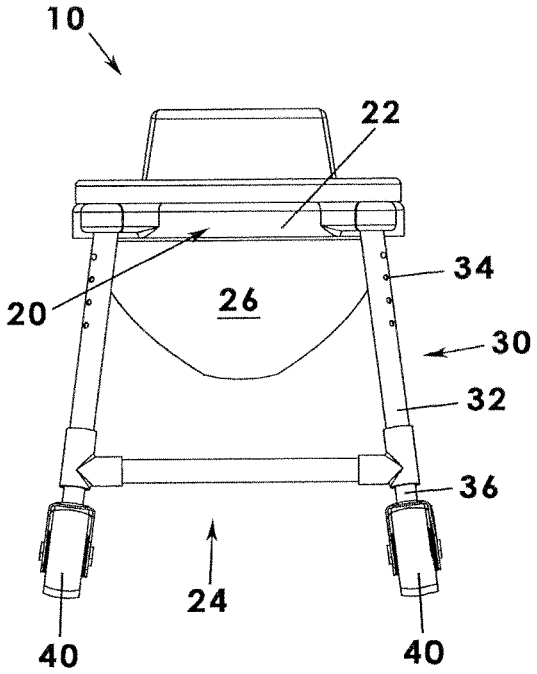
FIG. 2*c* is a front view of the mobility walker as in FIG. 1*a;*
Figure 2B:
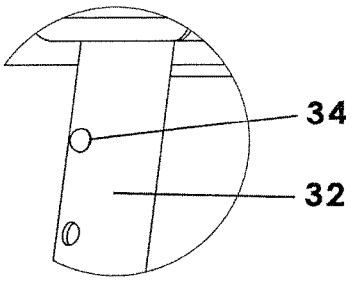
FIG. 2*b* is an isolated view on an enlarged scale taken from FIG. 2*a;*

A mobility walker for movement along a support surface according to a preferred embodiment of the present invention will now be described with reference to FIG. 1*a* to 3*b* of the accompanying drawings. The mobility walker 10 includes a top portion 20, bottom portion 24, child support portion 26, and a plurality of wheel assemblies 40.

The mobility walker 10 includes a framework having a top portion 20 supported an adjustable distance above a bottom portion 24. The top portion 20 may include a support rail 22 having a circular or ring-shaped configuration although other similar shape configurations may also work. The top portion 20 defines a horizontal plane that is parallel to the ground or support surface on which the mobility walker 10 is placed. Further, the mobility walker 10 may include a bottom portion 24 that is parallel to the top portion 20, also defines a horizontal plane, and are downwardly displaced from the top portion 20. Preferably, the bottom portion 24 includes four support rods coupled together within the horizontal plane defined by the bottom portion 24 in a square configuration.

The bottom portion 24 and top portion 20 are coupled together by four vertical support members 30 that extend therebetween. The top and bottom portions may include fasteners through which respective ends of respective vertical support members 30 may be received, such as in friction fit, threaded, or fixed configurations. The top portion 20, therefore, is supported by and displaced by the plurality of vertical support members 30, respectively. Each vertical support member 30 may also be referred to as a leg member or support leg.

Preferably, each vertical support member 30 is length adjustable. More particularly, each vertical support member 30 may include a first portion 32 (i.e. an upper portion) that extends between the top portion 20 and bottom portion 24 of the framework, the first portion 32 having a cylindrical configuration and that defines a hollow interior space. The first portion 32 also defines a plurality of apertures 34 that will enable length adjustment as described below. Each vertical support member 30 includes a second portion 36 also having a cylindrical configuration and at least one nub (not shown) thereon that has a dimension configured to mate with a selected aperture 34, whereby to enable length adjustment of the vertical support member 30. As implied above, the second portion 36 is slidably movable within the first portion 32 (i.e. a cylinder moving in a sleeve) between a retracted configuration fully positioned in the interior space of the first portion 32 and a deployed or extended configuration partially extended outside of the first portion 32.

In another aspect, the mobility walker 10 includes a child support portion 26 having a structure suitable to hold, retain, and support an infant or toddler. More particularly, the child support portion 26 may include a first end coupled to the support rail 22 of the top portion 20. The child support portion 26 may be constructed of a fabric having a flexible configuration that essentially hangs or is suspended from the support rail 22. The child support portion 26 may have a continuous construction defining a pair of laterally spaced apart leg holes 28 for receiving the legs of a seated infant and supporting the crotch thereof.

Figure 3A:
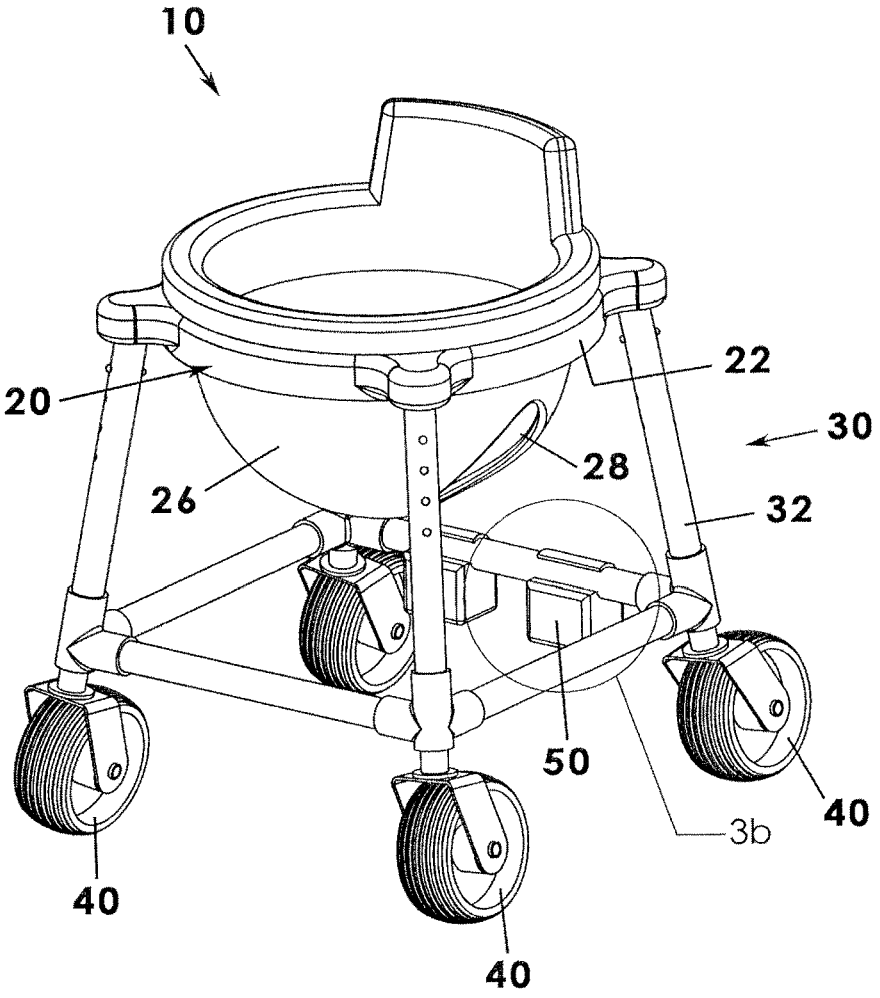
FIG. 3*a* is a perspective view of the mobility walker as in FIG. 1*a* illustrated with outdoor wheel assemblies.
Figure 3B:
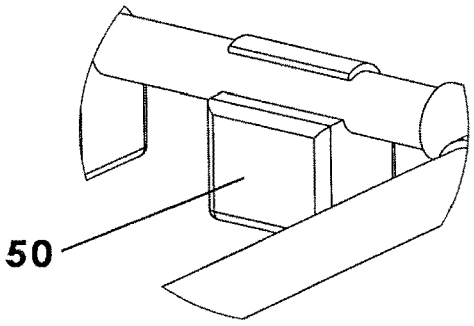
FIG. 3*b* is an isolated view on an enlarged scale taken from FIG. 3*a*.

In still another aspect, the mobility walker 10 includes a plurality of wheel assemblies 40 removably or releasably coupled to lower ends of the plurality of vertical support members 30, respectively. While the mobility walker 10 may include traditional castor wheels (FIG. 1), such as for indoor use, such wheel assemblies may be removed in favor of larger diameter outdoor-styled wheels (FIG. 3). Preferably, each wheel assembly includes actual rubber tires having an outdoor tread pattern (FIG. 3). Further, each wheel assembly 40 may a diameter in the 4 inches to 12 inches range and, preferably, 8.5 inches.

A critical feature of the mobility walker 10 according to the present invention is that a child seated therein is able to effectively peer over the front or side of the top portion 20 of the walker 10 and actually see the ground surface that is immediately adjacent the bottom portion 24 thereof. To accomplish this purpose, the plurality of vertical support members 30 must be substantially "vertical" rather than sharply angled as is common in walker design. For instance, it is contemplated that each vertical support member 30 has a vertical angle that is in a range from about 70 degrees to about 90 degrees and, preferably, between 80 and 90 degrees relative to the horizontal plane of the ground surface or horizontal plane of the bottom portion 24 of the framework.

In another aspect, at least one weight member 50 is releasably coupled to a selected support rod of the bottom portion 24 of the framework (FIG. 3). For instance, one or more weight members 50 coupled to a rear brace of the bottom portion 24 will offset the weight of a toddler seated in the seat member and, accordingly, prevent the front being top heavy or likely to tip over frontwards. Giving a user a selective option of adding or subtracting weights to the frame of a walker is unusual, unexpected, and non-obvious for a walker. However, this feature is advantageous in the present instance to offset the configuration of other features explained above.

It is understood that while certain forms of this invention have been illustrated and described, it is not limited thereto except insofar as such limitations are included in the following claims and allowable functional equivalents thereof.

The invention claimed is:

1. A mobility walker for movement along a support surface, comprising:

a framework having a top portion that includes a support rail having a generally ring-shaped configuration parallel to the ground surface, said framework having a bottom portion that includes four support rods distributed in a square configuration;

said framework having a plurality of vertical support members extending between said bottom portion and said top portion such that said top portion is supported above and displaced from said bottom portion;

a child support portion having a first end coupled to said support rail of said top portion and having a flexible configuration suspended from said top rail, said child support portion defining a pair of leg holes;

a plurality of wheel assemblies releasably coupled to lower ends of said plurality of vertical support members, respectively, each wheel assembly having a diameter between 4 inches and 12 inches;

wherein each vertical support member is length adjustable and includes:

a first portion extending between said bottom portion and said top portion of said framework, said first portion having a cylindrical configuration defining an interior space and a plurality of apertures; and a second portion having a cylindrical configuration and a nub received in a selected aperture of said plurality of apertures, said second portion received in said interior space and movable between a retracted configuration partially or completely inside said first portion and a deployed configuration partially extended outside aid interior space of said first portion.

2. The mobility walker as in claim 1, wherein each vertical support member defines a vertical axis oriented at an angle between 70 degrees and 90 degrees relative to the ground surface.

3. The mobility walker as in claim 2, wherein each vertical support member defines a vertical axis oriented at an angle between 80 degrees and 90 degrees relative to the ground surface.

4. The mobility walker as in claim 1, wherein each vertical support member defines a vertical axis oriented at an angle between 70 degrees and 90 degrees relative to a horizontal plane defined by said bottom portion of said framework.

5. The mobility walker as in claim 4, wherein each vertical support member defines a vertical axis oriented at an angle between 80 degrees and 90 degrees relative to a horizontal plane defined by said bottom portion of said framework.

6. The mobility walker as in claim 1, wherein said each wheel assembly has a diameter of 8.5 inches.

7. The mobility walker as in claim 1, wherein said each wheel assembly includes an off-road tread surface.

8. The mobility walker as in claim 7, wherein said plurality of wheel assemblies is interchangeable.

* * * * *